United States Patent [19]

Fagan et al.

[11] 4,097,007

[45] Jun. 27, 1978

[54] MISSILE GUIDANCE SYSTEM UTILIZING POLARIZATION

[75] Inventors: James J. Fagan; William F. Otto; William B. McKnight, all of Huntsville, Ala.

[73] Assignee: The United States of America as represented by the Secretary of the Army, Washington, D.C.

[21] Appl. No.: 722,837

[22] Filed: Sep. 13, 1976

Related U.S. Application Data

[63] Continuation-in-part of Ser. No. 514,697, Oct. 15, 1974, Pat. No. 3,995,792.

[51] Int. Cl.[2] ..... F42B 15/00

[52] U.S. Cl. ..... 244/3.11; 244/3.14; 356/152

[58] Field of Search ..... 244/3.11, 3.13, 3.14, 244/3.16; 250/203; 356/152

[56] References Cited

U.S. PATENT DOCUMENTS

| | | | |
|---|---|---|---|
| 3,374,967 | 3/1968 | Plumley | 244/3.14 |
| 3,603,686 | 9/1971 | Paine | 250/203 |
| 3,698,811 | 10/1972 | Weil | 244/3.14 |
| 3,848,830 | 11/1974 | Born | 244/3.16 |
| 3,899,145 | 8/1975 | Stephenson | 244/3.13 |
| 3,995,792 | 12/1976 | Otto, et al. | 244/3.14 |

*Primary Examiner*—Verlin R. Pendegrass
*Attorney, Agent, or Firm*—Nathan Edelberg; Robert P. Gibson; James T. Deaton

[57] ABSTRACT

A missile guidance system in which a projectile or missile is fired toward a predetermined target with the missile being tracked on its flight toward the target by radar, processing the radar information in a computer apparatus and finally computing a new trajectory from the missile to the target and transmitting correction signals to a correction device on the missile including thrusters on the missile to cause the trajectory of the missile to be changed to the newly computed trajectory for the missile. This system corrects the trajectory of the missile while in flight by recomputing a trajectory from the missile to the predetermined target and making appropriate corrections each time. This enables the missile to only contain radar reflecting means, and correction detection and control means on the missile rather than having gyro and other type devices on board the missile which take up a considerable amount of space and weight.

5 Claims, 6 Drawing Figures

MISSILE GUIDANCE SYSTEM UTILIZING POLARIZATION

DEDICATORY CLAUSE

The invention described herein may be manufactured, used, and licensed by or for the Government for governmental purposes without the payment to us of any royalties thereon.

CROSS REFERENCE TO RELATED APPLICATION

This application is a continuation-in-part of applicants' copending application Ser. No. 514,697, filed Oct. 15, 1974, and now U.S. Pat. No. 3,995,792.

BACKGROUND OF THE INVENTION

Weapon systems in the past have generally had projectiles with no appreciable means for correcting the trajectory of the projectile or missile after being fired or they have included elaborate mechanisms such as radar detectors and sophisticated gyro guidance means that have taken up considerable weight and space on board the projectile or missile.

Therefore, it is an object of this invention to provide a system that utilizes a low cost per round projectile or missile that has no internal gyros or costly controls therein.

Another object of this invention is to provide a missile system that utilizes a projectile or missile that has high velocity and can perform as conventional artillery.

A further object of this invention is to provide a system which retains the effectiveness of normal artillery even with complete failure of the radar.

Still another object of this invention is to provide a system that can utilize conventional rounds in the gun type launcher with radar giving target range.

A still further object of this invention is to provide a system in which the missile or projectile has low spin rates with high accuracy which permit the use of shape charge warheads that have the capability of defeating hard targets.

SUMMARY OF THE INVENTION

In accordance with this invention, a missile guidance system is provided which includes a predetermined target area with a missile or projectile launcher mounted in a predetermined relationship thereto, a missile or projectile with polarized radar reflecting and detecting means thereon, a radar tracker for sending and receiving signals from the radar reflector on the missile and a command computer interconnected with the tracker and detector for computing the measured projectile position and velocity and producing error corrections therefrom in the form of a new trajectory from said missile to said target. This is accomplished by sending correction coded radar signals by the radar tracker to the correction device on board the missile or projectile. The correction device has thrusters which correct the missile or projectile to cause it to be directed in the newly computed trajectory from the missile or projectile to the target.

DESCRIPTION OF THE PREFERRED EMBODIMENT

Figure 1:
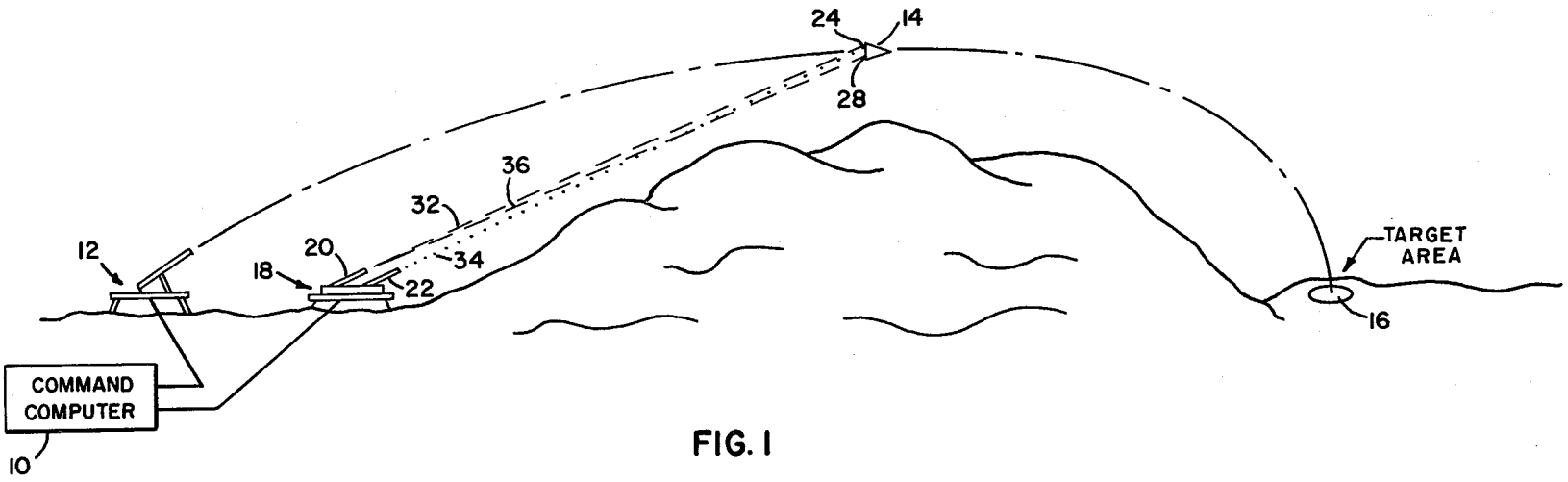
FIG. 1 is a pictorial view of a missile system according to this invention.

Referring now to FIG. 1, a system according to this invention is pictorially illustrated and includes a command computer 10 that is interconnected for controlling launcher 12 which launches missiles such as missile 14 in a predetermined trajectory to target area 16. Command computer 10 also controls tracker 18 which has transmitter means 20 and detector means 22. Missile 14 contains a polarized reflector 24 for receiving electromagnetic beam 32 and for returning beam 34 as a polarized signal to polarizer detector 22. Missile 14 also has detector receiver means 28 for receiving coded correction signals 36 from transmitter 20 to actuate appropriate side thrusters on the missile and thereby correct the course of missile 14 on an appropriate trajectory to target 16.

Figure 3:
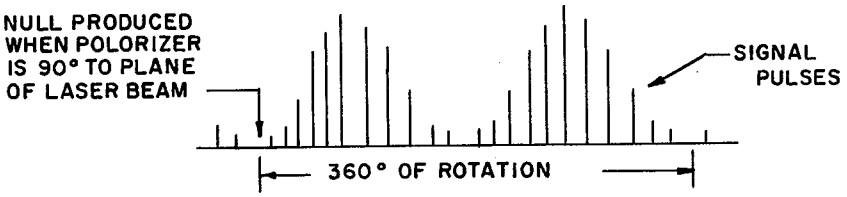
FIG. 3 illustrates the detected signal pulses from the polarizer on board the missile.
Figure 2:
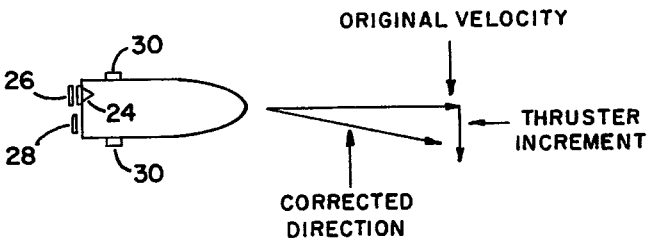
FIG. 2 schematically depicts a projectile being corrected by thrusters and directed in the newly computed trajectory.
Figure 4:
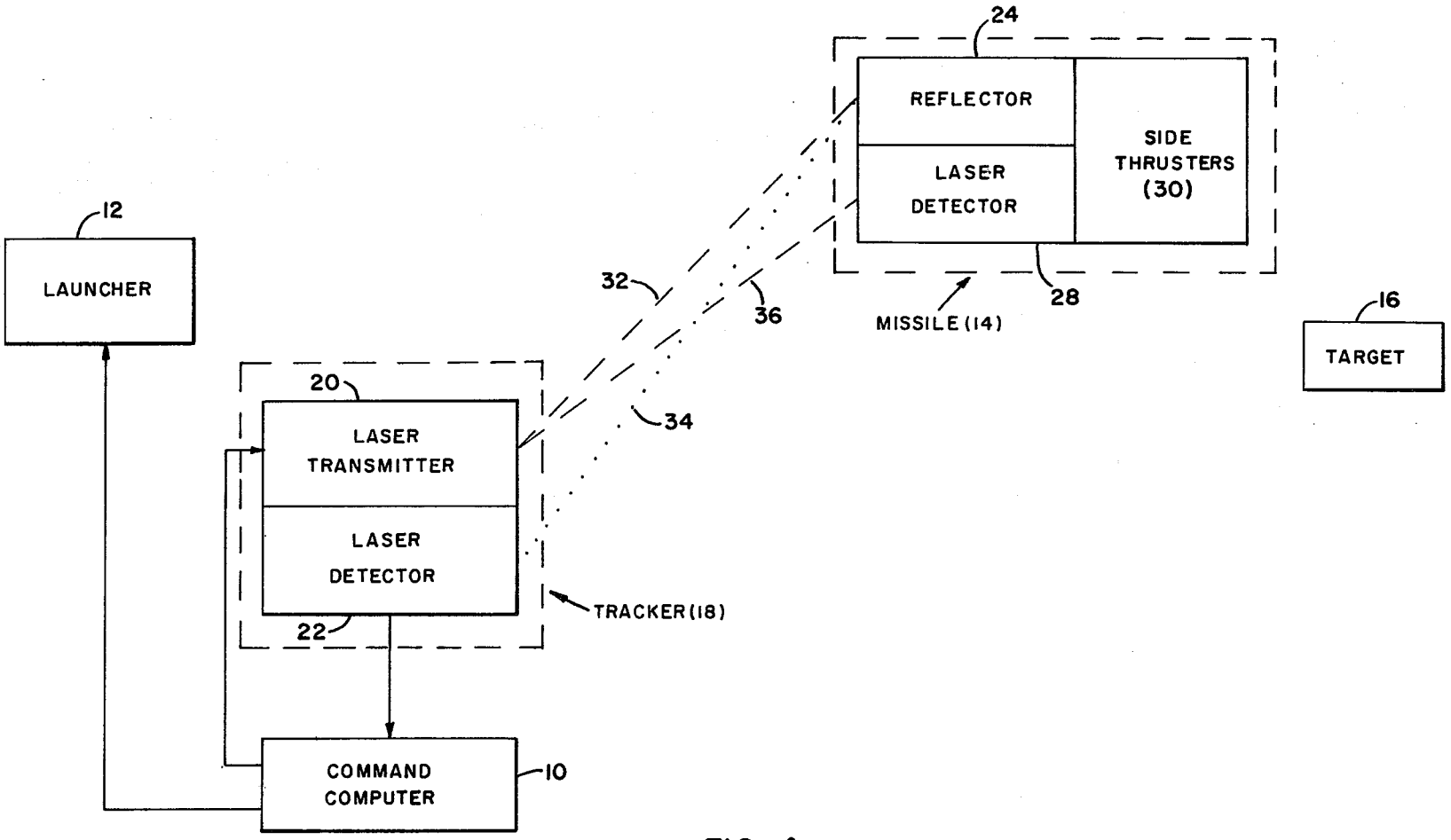
FIG. 4 illustrates a block diagram of the components of the laser system according to this invention.

The system illustrated in FIGS. 2–4 includes laser transmitter 20 that can be a Q-switch type laser allowing the use of pulse code modulation. For example, pulses could be transmitted 1000 times per second for normal tracking. The command to fire a thruster could be a group of three pulses separated by 200 microseconds. The laser transmitter may also contain two lasers, one for transmitting a particular different frequency to the reflector and another for transmitting a particular frequency to the receiver on the missile. Laser transmitter 20 transmits a beam that has a beam angle of approximately 0.5 milliradian. For example, a beam diameter of 10 centimeters at the laser transmitter would have a diameter of approximately 150 centimeters at a distance of 3000 meters from the laser transmitter.

Reflector 24 in this embodiment (see FIG. 2) is a conventional triangular cube type reflector for example that has a side of approximately 2 centimenters. This size gives an area of 1.73 square centimeters. Polarizer 26 at the face of reflector 24 causes the return signal from corner reflector 24 to be polarized and to be amplitude modulated due to rotation of missile 14. The form of amplitude modulated detector signal is shown in FIG. 3. By the amplitude modulation signal from the laser detector, by knowing the predetermined roll rate of the missile at launch and by knowing the predetermined position of the missile at launch, command computer 10 is able to determine the appropriate side thrusters 30 to be actuated and cause the missile to be corrected and directed into a trajectory that will lead from the missile to target 16. Alternatively, because of the narrow beam and the resultant spatial resolution of the tracking laser radar at close range, the reflection from the corner reflector mounted in the fin offset from the center of the missile will have an apparent spiral motion which can be used to determine the roll attitude of the missile while it is close to the tracker. This roll attitude can be retained and used by the computer to index the modulation of the returned signal from the reflector at longer ranges so that the thrusters may be fired at the proper roll position. A third means for indexing the modulation of the return signal to indicate roll attitude may be by firing a thruster and observing with the tracker the resultant motion of the missile.

Laser detector 22 utilizes a conventional P-I-N spot detector that has four quadrants separated by crosshair cruciform area. The laser reflections from missle 14 are detected by spot detector 22 and the processed signals therefrom are transmitted to command computer 10 to allow command computer 10 to reposition laser tracker 18 and maintain the laser beam on missile 14. Command computer 10 also computes a new trajectory from missile 14 to target 16 by comparing the newly established position of missile 14 relative to the predetermined trajectory that was initially programmed into command computer 10 to determine the error signals that must be transmitted to missile 14 through laser 20 to laser detector 28 to cause the appropriate side thrusters 30 to be actuated. The number of side thrusters 30 will depend upon the particular requirements and accuracy required of the missile in its application. Sequencing circuits in missile detector 28 switches from one pair of thrusters to the next automatically, but the time of firing is determined by ground command computer 10.

Figure 5:
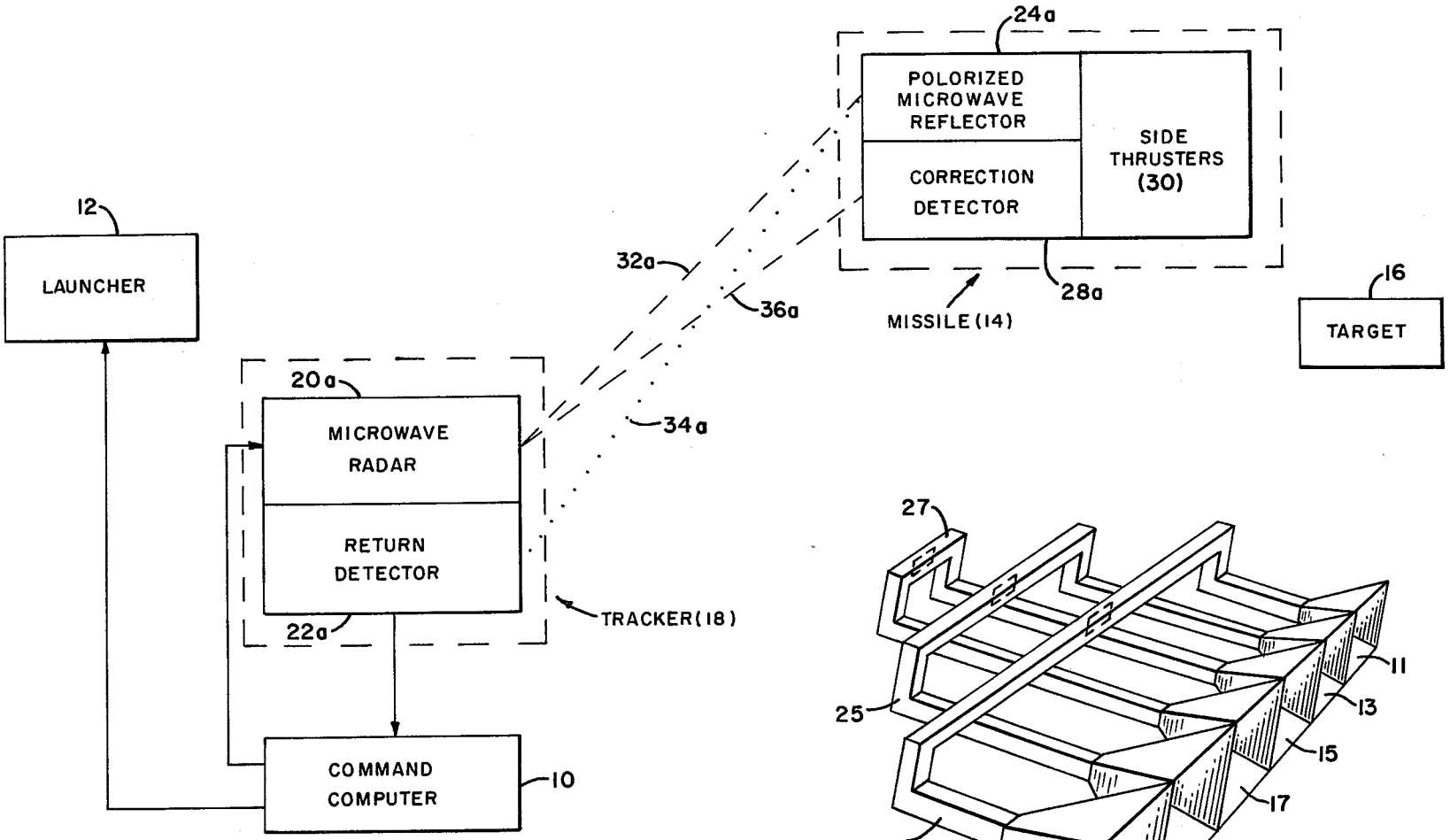
FIG. 5 illustrates a block diagram of the components of a microwave system according to this invention.
Figure 6:
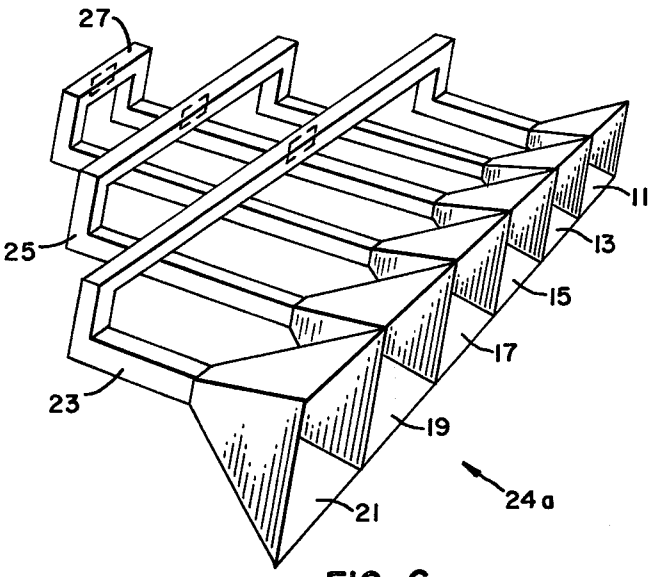
FIG. 6 illustrates a linear polarized antenna array utilized in this invention.

An alternative embodiment of this invention (see FIGS. 5 and 6) is the substitution of microwave radar **20*a* for laser transmitter 20 of FIG. 4. In this embodiment missile 14 contains polarized microwave reflector 24*a* mounted in the fin in place of optical corner reflector 24 (FIG. 2), and coded radar receiver 28*a* for receiving coded correction radar signals 36*a* from microwave radar 20*a* of tracker 18 to actuate appropriate side thrusters 30 on missile 14 and thereby correct the course of missile 14 on an appropriate trajectory to target 16**.

The microwave radar can be either a pulsed or C.W. set transmitting a circular polarized beam. A radar operating at K band with a beam width of one half degree provides tracking to the order of 1 to 2 milliradians which is adequate. In the case of a pulse radar, the command to fire thrusters can be a change in the pulse repetition frequency in a set coded pattern. Similar command can be achieved in a C.W. radar by a change in the carrier frequency or the modulation impressed thereon to obtain range information.

Polarized microwave reflector **24*a* in this alternative embodiment is for example a linear polarized Van Atta array of antenna elements (see FIG. 6) arranged within the trailing edge of a fin of the missile. The Van Atta array consists of a number of antenna elements 11, 13, 15, 17, 19 and 21 which are placed symmetrically with respect to the geometrical center and are connected in pairs by transmission lines 23, 25, 27** of equal length. A wave incident upon the antenna is reradiated in phase back in the direction of incidence for all angles of incidence. For further details of the Van Atta array, see U.S. Pat. No. 2,908,002 issued Oct. 6, 1959.

The polarization of the array causes the return signal from reflector **24*a* to be linearly polarized. The return signal is received simultaneously at conventional return detector 22*a*** through two channels whose polarization is orthogonal to each other. The output of these two channels are subsequently processed to measure the polarization rotation independent of the amplitude distortion caused by the propagation effects.

A 180° ambiguity in roll position remains in the signal being processed which may be removed by any of the following means. By knowing the predetermined roll rate of the missile at launch and by knowing the predetermined position of the missile at launch, command computer 10 is able to determine the proper roll attitude for thruster firing. Alternatively, because of the narrow beam and the resultant spatial resolution of the tracking radar at close range, the reflection from the array mounted in the fin offset from the center of the missile will have an apparent spiral motion which can be used to determine the roll attitude of the missile while it is close to the tracker. This roll attitude can be retained and used by the computer to index the modulation of the returned signal from the reflector at longer ranges so that the thrusters may be fired at the proper roll position. A third means for indexing the modulation of the return signal to indicate roll attitude may be by firing a thruster and observing with the tracking radar the resultant motion of the missile.

Command computer 10 computes a new trajectory from missile 14 to target 16 by comparing the newly established position of missile 14 relative to a predetermined trajectory that is initially programmed into command computer 10 in the same way as defined for the laser tracker. Coded signals **36*a* are transmitted by microwave radar 20*a* to correction detector 28*a* which causes appropriate side thrusters 30** to be actuated.

In each of these systems, several corrections of the missile toward its target can be made. However, in weather adverse to propagation as in the laser case the final correction may occur about 4 seconds after launch. This correction of the missile reduces the launch errors considerably and makes the missile accuracy equivalent to the accuracy attainable with heavy artillery. Normally, atmospheric conditions will permit the radar to continue to track the missile to slant ranges of 25 kilometers. When this is the case and any new errors are detected (for example due to cross winds), additional commands are sent to the missile to further decrease impact errors.

In operation, a target 16 is located by appropriate means and a trajectory from launcher 12 to target 16 is determined and programmed into command computer 10. Command computer 10 is then controlled to cause launcher 12 to launch missile 14 into the predetermined trajectory and tracker 18 tracks missile 14 by transmitting beam 32 or **32*a* (see FIGS. 4 and 5) toward reflector 24 or 24*a* on board missile 14. The reflected signal is polarized and returned as beam 34 or 34*a* to detector 22 or 22*a*. Detector 22 or 22*a* receives the polarized signal and produces an output in accordance with the present position of missile 14. The signals from detector 22 or 22*a* are transmitted to command computer 10 and compared with the predetermined trajectory that was initially programmed into command computer 10. Any errors in the present position of missile 14 are detected by command computer 10 and error signals accordingly are generated to cause signals from laser 20 or microwave radar 20*a* to be transmitted as correction coded signals 36 or 36*a* to detector 28 or 28*a* and thereby cause appropriate side thrusters 30 to be actuated and cause missile 14 to be directed into a new trajectory relative to target 16. This procedure for correcting missile 14 is repeated as desired until missile 14 is out of range of tracker 18**.

We claim:

1. A missile system for guiding a missile to a predetermined target comprising a launcher for launching a missile in a predetermined trajectory from the launcher to the target and in which said missile is rotating, said missile having polarized reflector means thereon and detector receiver means interconnected to side thrusters on the missile for correcting the course of the missile; a tracker for tracking said missile and including radar transmitter means for transmitting electromagnetic rays to said polarized reflector means and said detector receiver means and further including return detector means for detecting polarized reflections from said polarized reflector means; and a command computer means interconnected to said launcher and said tracker for control thereof, said command computer means having a predetermined trajectory from the launcher to the target programmed therein, said command computer means receiving information from said tracker and said return detector means and comparing said received information with said predetermined trajectory to cause error signals to be transmitted as correction coded signals from said radar transmitter means to said detector receiver means to cause appropriate ones of said side thrusters to be actuated and cause the missile to be directed into a new trajectory relative to the target.

2. A missile system as set forth in claim 1, wherein said radar transmitter means includes a laser radar, and said polarized reflector means includes a corner cube reflector with a polarizer at the face thereof.

3. A missile system as set forth in claim 2, wherein said return detector means includes a P-I-N spot detector with four quadrants.

4. A missile system as set forth in claim 1, wherein said radar transmitter means includes a microwave radar transmitter, and said detector receiver means includes a linear polarized microwave reflector.

5. A missile system as set forth in claim 4, wherein said return detector means includes two channels whose polarization is orthogonal to each other.

* * * * *